United States Patent [19]

Potocnjak

[11] Patent Number: 4,842,150

[45] Date of Patent: Jun. 27, 1989

[54] APPARATUS FOR STABILIZING THE LOAD OF A CRANE OR THE LIKE

[75] Inventor: Tomislav Potocnjak, Lauffen/Neckar, Fed. Rep. of Germany

[73] Assignee: TEPORA Transportsysteme Entwicklings-GmbH, Lauffen, Fed. Rep. of Germany

[21] Appl. No.: 173,277

[22] Filed: Mar. 25, 1988

[30] Foreign Application Priority Data

Mar. 26, 1987 [DE] Fed. Rep. of Germany ..... 3709960

[51] Int. Cl.[4] ..... B66C 13/06

[52] U.S. Cl. ..... 212/147; 212/146

[58] Field of Search ..... 212/146, 147, 148, 153; 414/735

[56] References Cited

U.S. PATENT DOCUMENTS

| | | | |
|---|---|---|---|
| 3,043,444 | 7/1962 | Melton | 212/147 |
| 3,308,966 | 3/1967 | Fawell | 212/147 |
| 3,743,107 | 7/1983 | Verschoof | 212/148 |
| 3,971,478 | 7/1976 | Matasa | 212/147 |
| 4,376,487 | 3/1983 | Van Soest et al. | 212/146 |
| 4,471,877 | 9/1984 | Whitly | 212/147 |

FOREIGN PATENT DOCUMENTS

| | | | |
|---|---|---|---|
| 1251545 | 12/1960 | France | 212/147 |
| 567658 | 8/1977 | U.S.S.R. | 212/146 |

*Primary Examiner*—Sherman D. Basinger
*Assistant Examiner*—Stephen P. Avila
*Attorney, Agent, or Firm*—Becker & Becker, Inc.

[57] ABSTRACT

An apparatus for a crane or the like to stabilize a load carried thereby. A first guide mechanism can be disposed on the carriage of the crane. This guide mechanism has guide cables that can be wound on cable drums, and that diverge to form an approximately pyramid shape. A second guide mechanism can also be provided. This guide mechanism has two diverging hydraulic cylinders and a horizontal girder that together form the shape of a triangle.

15 Claims, 4 Drawing Sheets

3
1
5
2
13
13
11
11
12
12
22
7
22
9
19
9
4
17
16
17
14
18
37
37
36
36
33
15
25
28
28
46
40
32
27
26
24
43
42
40
40
44
44
45
39
29
29
41
38
39
31
31
30

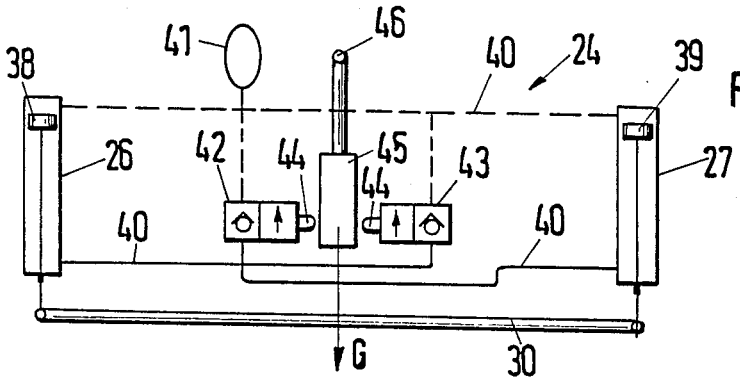
Fig. 4
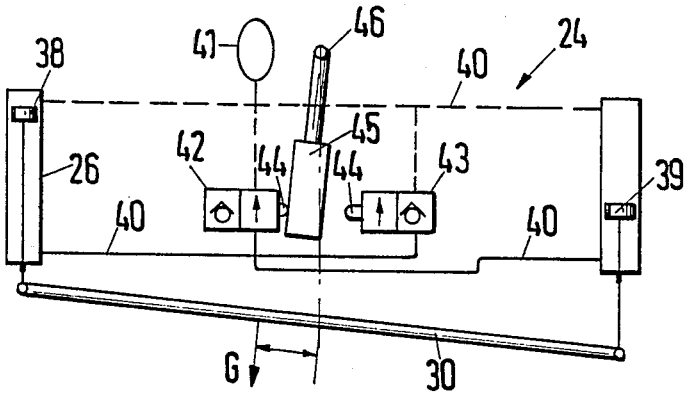
Fig. 5
Fig. 7
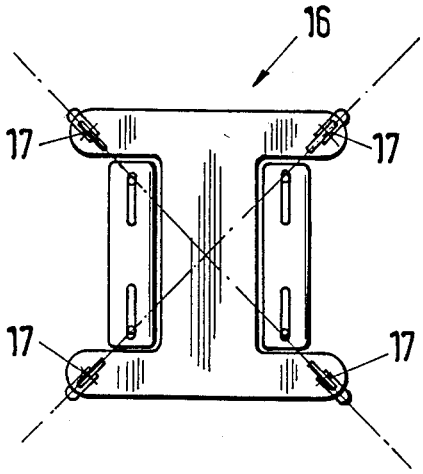
Fig. 6
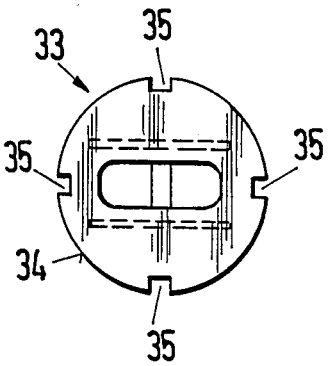

APPARATUS FOR STABILIZING THE LOAD OF A CRANE OR THE LIKE

BACKGROUND OF THE INVENTION

The present invention relates to an apparatus for a crane, for example a travelling crane, or the like to stabilize a load carried thereby. The crane includes a support structure that can be raised or lowered by a lifting mechanism of a movable carriage.

During the transport of a load that is suspended on a heretofore known crane, it is observed that the load swings back and forth when the crane or carriage moves along and slows down due to the effect of inertial forces, whereupon the load must be stabilized by hand. It is also observed that especially bulky or long, rod-like loads are generally suspended off-center, so that they hang lopsided or at an angle, and must therefore be subsequently straightened; in many cases, the load must frequently be deposited and raised for this purpose. Although mechanical and electronic devices are known that are intended to eliminate swinging of the load, these devices are expensive because completely different drive units and controls are used than those that are provided for a standard crane, so that a retrofitting of an existing crane is generally impossible due to the extensive conversions and considerable costs that are necessary.

It is therefore an object of the present invention to provide an apparatus of the aforementioned general type with which a load can be guided and transported in a reliably stabilized manner on an existing standard crane, with straightforward means, without having to undergo significant structural modifications.

BRIEF DESCRIPTION OF THE DRAWINGS

This object, and other objects and advantages of the present invention, will appear more clearly from the following specification in conjunction with the accompanying schematic drawings in which:

FIG. 4 is a hydraulic circuit diagram for levelling the load on the crane of FIGS. 1 and 2, in a normal position;

FIG. 5 shows the hydraulic circuit diagram of FIG. 4, with the girder tilted;

FIG. 6 is a plan view of the safety plate of the inventive apparatus, and is taken in the direction of the line VI—VI in FIG. 1; and FIG. 7 is a plan view of the guide plate of the inventive apparatus, and is taken in the direction of the line VII—VII in FIG. 1.

SUMMARY OF THE INVENTION

Figure 1:
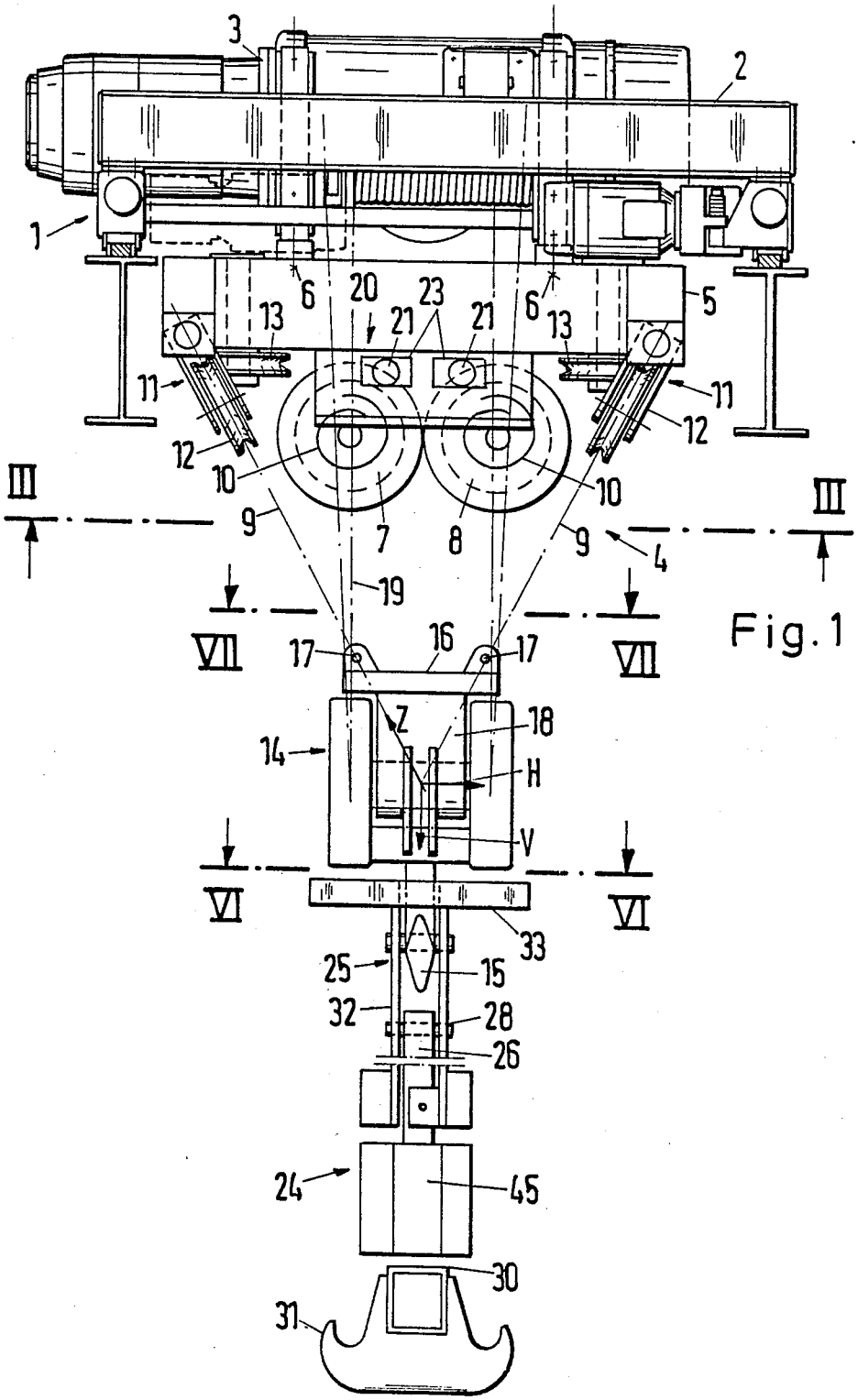
FIG. 1 is a front view of a crane that is provided with one exemplary embodiment of the inventive apparatus.

Pursuant to a first embodiment of the present invention, the inventive apparatus comprises a guide mechanism that is connected to the carriage and includes: guide means; guide cables that are connected to the support structure and extend in a diverging manner from the latter to the guide means in such a way as to essentially form the shape of an upside-down pyramid, with the guide means defining the base of the pyramid; and at least one cable drum to which the guide cables, coming from the guide means, are fixed for winding and unwinding these guide cables, with the cable drums being provided with spring-wound motor means for keeping the guide cables taut.

Pursuant to another embodiment of the present invention, the inventive apparatus comprises a guide mechanism that is disposed on the support structure and includes: downwardly diverging hydraulic cylinders with piston rods; a girder that is provided with load-receiving means and is connected to the piston rods of the hydraulic cylinders, remote from the support structure, in such a way as to essentially form the shape of a triangle, with the girder defining the base of the triangle; and a hydraulic line that interconnects the hydraulic cylinders for alternate retraction and extension of the piston rods thereof.

Pursuant to a further embodiment of the present invention, the inventive apparatus can be provided with both of the aforementioned guide mechanisms.

Further specific features of the present invention will be described in detail subsequently.

DESCRIPTION OF PREFERRED EMBODIMENTS

Referring now to the drawings in detail, the apparatus of the present invention is provided for guiding and stabilizing loads especially long goods, and is disposed on a standard or mass-produced travelling crane that is provided with a movable or travelling trolley carriage 1 that includes a carrier 2 and a lifting mechanism 3. Disposed on the carriage 1 is a guide mechanism 4 that includes a frame structure 5 that is secured to the carrier 2 via screws or bolts 6.

Figure 3:
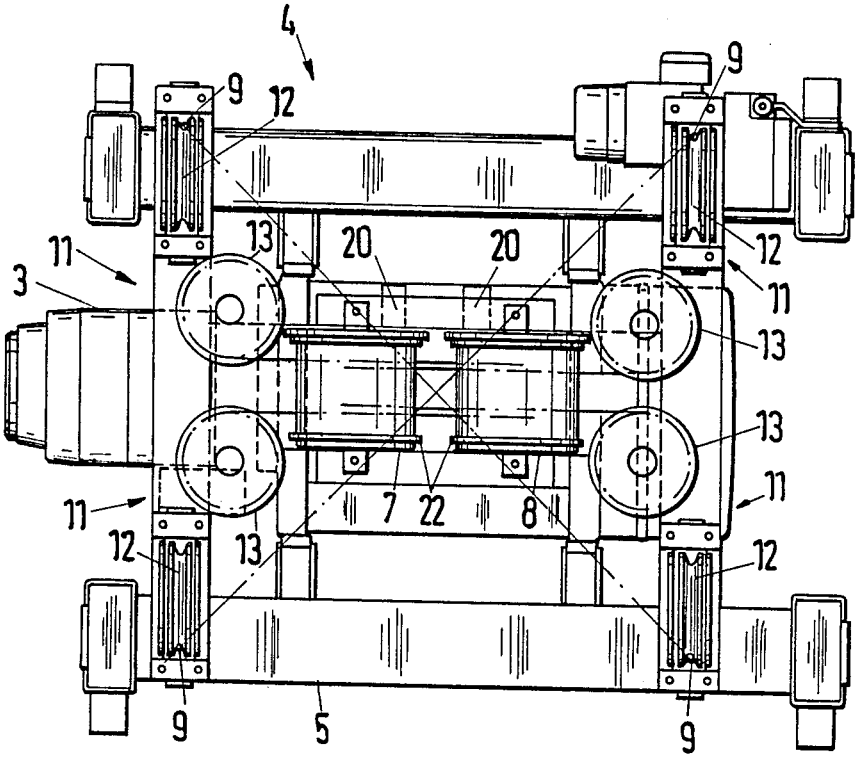
FIG. 3 is a view of the crane of FIG. 1 taken in the direction of the arrows III—III in FIG. 1.

Disposed approximately in the center of the frame 5 are two cable drums 7, 8 on each of which two guide cables 9 are disposed in such a way that they can be wound or unwound. For this purpose, a respective spring-wound motor 10 is provided in each of the two cable drums 7, 8. The four guide cables 9 are each guided via a guide mechanism 11 that is provided on the frame 5. Each guide mechanism 11 includes a swinging cable pulley 12 and a stationary yet rotatable cable pulley 13. The swinging cable pulleys 12 are secured to four outer corner regions of the frame 5, while the stationary cable pulleys 13 are disposed in the regions between the cable drums 7, 8 and the swinging cable pulleys 12 (see FIG. 3).

Thus, starting from the cable drums 7, 8, the guide cables 9 extend first via the stationary cable pulleys 13 to the four outer cable pulleys 12, where the cables 9 are guided downwardly. The four points of the cable pulleys 12 where the direction of the cables 9 is changed approximately form a square.

Disposed at a distance below the cable drums 7, 8, in the vertical central axis of the rectangle or square formed by the four reversal points of the cable pulleys 12, is a support structure 14 that is vertically adjustable via the lifting mechanism 3, and that is provided with a crane hook 15. A guide plate 16 can be disposed on the support structure 14. The guide plate 16 has four links 17 to which the lower ends of the four guide cables 9 are secured.

The guide plate 16 itself also has an approximately square configuration, with the links 17 being disposed in the four corner regions of the guide plate 16, as shown in FIG. 7. The links 17 are disposed at a distance relative to one another that is considerably less than the distance between the reversal points of the cable pulleys 12, so that the guide mechanism 4 with the four guide cables 9 basically forms an upside down pyramid.

Below the guide plate 16, the support structure 14 is preferably provided with a ballast 18 in order to assure adequate preload of the lifting cable 19 that is associated with the lifting mechanism 3 and via which the support structure 14 can be raised and lowered. The ballast 18 is designed in such a way that its weight corresponds approximately to the preloading of all of the spring-wound motors 10, which are preferably integrated into the cable drums 7, 8.

A locking mechanism 20 can be provided in order to prevent an accidental winding or unwinding of the guide cables 9, for example when a load swings. In a preferred embodiment, the locking mechanism 20 can be provided with a locking pin 21 that meshes with the teeth of a gear ring 22. Expediently, each of the cable drums 7, 8 is provided with a gear ring 22, and a respective locking pin 21 can be provided for each of the gear rings; the locking pins 21 can be secured to the underside of the frame 5. Each locking pin 21 can advantageously be inserted and withdrawn via an electromagnet 23 that is preferably connected via an electrical line to the electric motor of the lifting mechanism 3, and can be controlled by this motor.

A further inventive guide or control mechanism 24 can be provided on the support structure 14. In the illustrated embodiment, the guide mechanism 24 is suspended on the crane hook 15 of the lifting mechanism 3 via an attachment 25. Two hydraulic cylinders 26, 27 can be linked to the attachment 25 via pins or bolts 28. The hydraulic cylinders 26 27 diverge downwardly in opposite directions, with the lower ends of the hydraulic cylinders being linked to an approximately horizontal girder or traverse 30 via pins 29. The bar or girder 30, and the hydraulic cylinders 26, 27, form a triangle, one apex of which is directed upwardly. Hook-like load-receiving means 31 can be disposed on the girder 30; preferably rod or bar-shaped loads, long modular goods, etc. can be suspended on the load receiving means 31.

Figure 2:
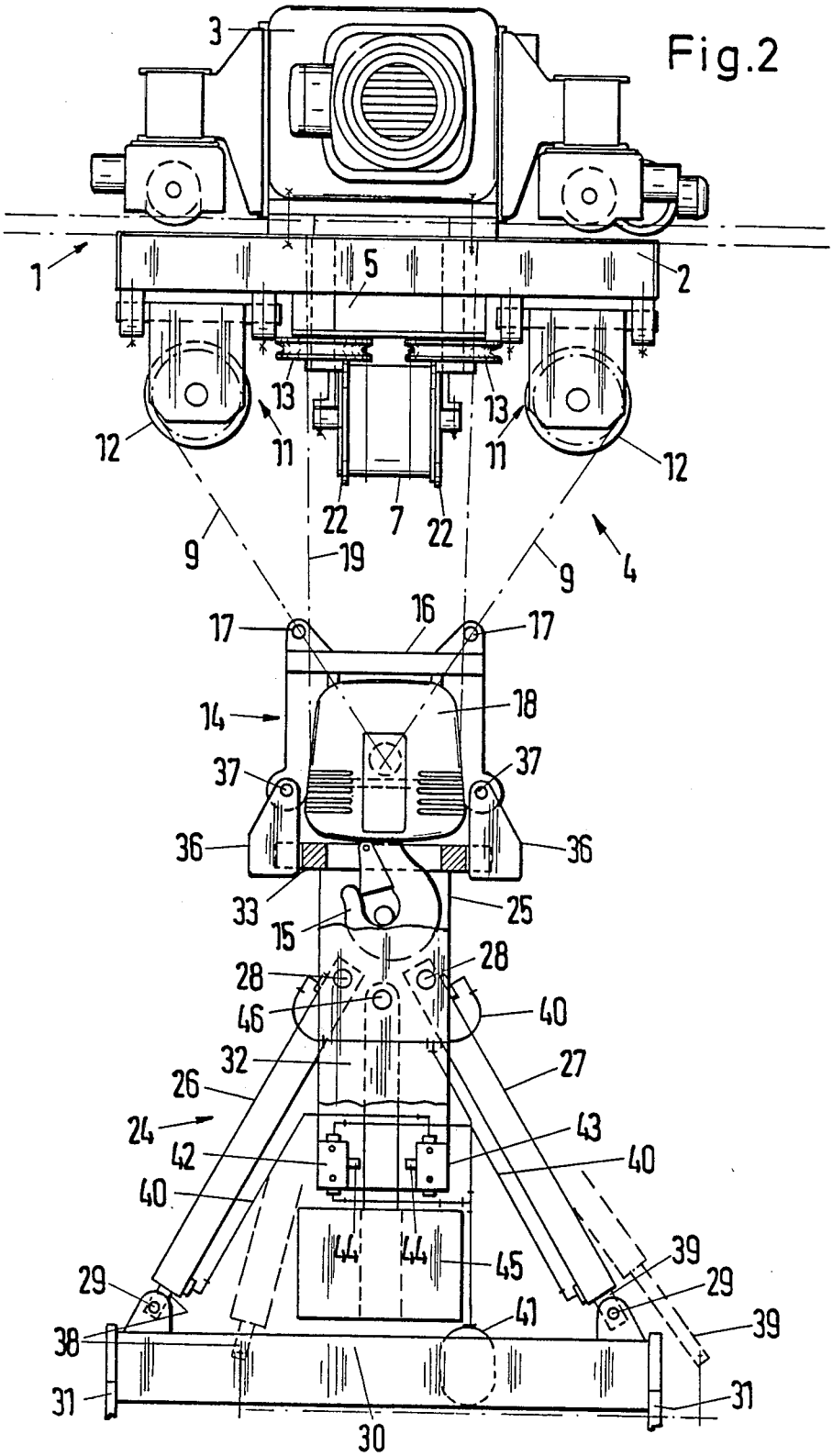
FIG. 2 is a side view of the crane of FIG. 1.

A safety plate 33 can be disposed on the support body 32 of the attachment 25. As shown in FIG. 6, the safety plate 33 can preferably be embodied in the manner of a circular disk, with four notches 35 being provided across from one another on the peripheral rim 34. As shown in FIG. 2, pawls 36 that can be hingedly mounted on the support structure 14 via pins 37 can engage in the notches 35. When the pawls 36 engage in the notches 35, the guide mechanism 24 is prevented from turning about the vertical axis.

In order to provide for an alternate retraction and extension of the piston rods 38, 39 of the hydraulic cylinders 26, 27, the latter are interconnected via a hydraulic line 40 with which are also associated a hydraulic reservoir 41 and two valves 42, 43. The switching stems 44 of the valves 42, 43 face one another and are spaced from one another. Disposed in the space between the two switching stems 44 is a pendulum 45 that is pivotably connected to the support body 32 of the attachment 25, in the vertical axis of the guide mechanism 24, on a pin 46.

If the support structure 14 is lowered via the lifting mechanism 3, the guide cables 9 are unwound by the cable drums 7, 8. The guide cables 9 remain tensioned during this process due to the preloaded spring-wound motors 10 that are provided in the cable drums 7, 8. The swinging forces that occur, for example during movement of the carriage 1, can be absorbed by the guide or control mechanism 4. When no power is supplied to the lifting mechanism 3; the locking pins 21 are extended and engage the teeth of the gear rings 22, thus preventing turning of the cable drums 7, 8. If, for example, the travelling crane is moved to the left, the horizontal force H (FIG. 1) that is directed toward the right is diverted into the guide cable 9 as the tensile force Z. When the lifting mechanism 3 is switched on, the electromagnets 23 withdraw the locking pins 21 from the teeth of the gear rings 22, thus releasing the cable drums 7, 8, so that the guide cables 9 can be retracted or withdrawn when the load is raised or lowered. The directional stability of the support structure 14 results from the fact that the links 17 for the guide cables 9 on the guide plate 16 are provided at a considerably smaller distance relative to one another than is the distance between the reversal points of the cable pulleys 12. If a twisting moment occurs, the load is raised by the guide cables 9 by straightening the guide plate 16.

Tilting that occurs because a load is off-center can be counteracted by the guide mechanism 24. As long as the center of gravity of the load G is below the point of suspension, with the girder 30 raised, the pendulum 45 remains centrally between the valves 42, 43, which are switched to the position "check valve". However, if a load G is suspended in such a way that the center of gravity is, for example, to the left of center, the right side of the girder 30 is first raised. The pendulum 45 slides (relatively) to the left, presses the valve 42 as shown in FIG. 5 into the position "pass" and the hydraulic oil flows out of the tension region of the right hydraulic cylinder 27 into the hydraulic reservoir 41 until the girder 30 has moved to the right to such an extent that the center of gravity of the load is again disposed below the attachment. The pendulum 45 is then again disposed in the central position between the valves 42, 43, so that the valve 42 closes.

The required switching force for the valve 42 or 43 can be approximately 5 daN, and is achieved with a sufficiently heavy pendulum 45, which can be provided with a weight at the bottom, already at an inclination of the girder 30 of less than 1°. This is considerably less than the slide angle of the loads that are customarily to be transported.

In order to prevent the load from arbitrarily turning during transport, the safety plate 33 is provided on the upper portion of the support body 32, with the pawls 36 engaging in the notches 35 of the safety plate, so that the support body 32 cannot rotate relative to the support structure 14. However, if the load is intentionally to be rotated, the pawls 36 can be retracted in order to release the safety plate 33, so that the load can be rotated about the axis of the crane hook, which is preferably provided with a ball bearing.

An important advantage of the present invention is that the inventive apparatus can be mounted with minimum effort on an existing crane or crane carriage, and the loads that are to be transported with a crane that is retrofitted in this manner are stabilized in a substantially swing-free manner and can be transported in such a way that they are straightened relative to any tilting. It is also within the scope of the present invention to provide either only the guide mechanism 4 on the carriage 1 or to suspend only the guide mechanism 24 without the guide mechanism 4 on the support structure 14 in order to hold the load nearly horizontal via this levelling mechanism. On the whole, with the inventive apparatus the loads that are to be transported can be remotely controlled, and precisely deposited without manual assistance.

The present invention is, of course, in no way restricted to the specific disclosure of the specification and drawings, but also encompasses any modifications within the scope of the appended claims.

What I claim is:

1. An apparatus for installation on an existing crane or the like to stabilize against swinging of a load carried thereby, with said crane including a support structure that can be raised or lowered by a lifting mechanism of a movable carriage of the crane, said apparatus comprising:

a guide mechanism that is connected only to said carriage of the crane and includes: guide means; guide cables that are connected with one end thereof relative to said support structure adjustable in height thereby and extend in a diverging manner from the latter to said guide means in such a way as to essentially form the shape of an upside-down pyramid, with said guide means defining the base of said pyramid; and at least one cable drum to which said guide cables, coming from said guide means, are fixed for winding and unwinding said guide cables, with said at least one cable drum being provided with spring-wound motor means for keeping said guide cables taut;

a locking mechanism to prevent said at least one cable drum from unintentionally winding and unwinding said guide cables, said at least one cable drum being provided with tooth means, said locking mechanism including locking pin means adapted to engage said tooth means and adapted to be withdrawn from said tooth means to permit winding and unwinding of said guide cables, said carriage including a carrier that supports a frame structure on which said at least one cable drum and said locking mechanism are disposed.

2. An apparatus according to claim 1, which includes a cable drum for each two guide cables.

3. An apparatus according to claim 2, which includes four guide cables and two cable drums, with the latter being centered between four guide means.

4. An apparatus for a crane or the like to stabilize a load carried thereby, with said crane including a support structure that can be raised or lowered by a lifting mechanism of a movable carriage, said apparatus comprising:

a guide mechanism that is connected to said carriage and includes: guide means; guide cables that are connected to said support structure and extend in a diverging manner from the latter to said guide means in such a way as to essentially form the shape of an upside-down pyramid, with said guide means defining the base of said pyramid; and at least one cable drum to which said guide cables, coming from said guide means, are fixed for winding and unwinding said guide cables, with said at least one cable drum being provided with spring-wound motor means for keeping said guide cables taut;

a cable drum for each two guide cables, including four guide cables and two cable drums, with the latter being centered between four guide means;

a locking mechanism to prevent said cable drums from unintentionally winding and unwinding said guide cables;

said cable drums being provided with tooth means, and said locking mechanism including locking pin means adapted to engage said tooth means;

said lifting mechanism being provided with an electric motor; and electromagnetic means controlled by said electric motor for actuation of said locking pin means.

5. An apparatus for a crane or the like to stabilize a load carried thereby, with said crane including a support structure that can be raised or lowered by a lifting mechanism of a movable carriage, said apparatus comprising:

a guide mechanism that is connected to said carriage and includes: guide means; guide cables that are connected to said support structure and extend in a diverging manner from the latter to said guide means in such a way as to essentially form the shape of an upside-down pyramid, with said guide means defining the base of said pyramid; and at least one cable drum to which said guide cables, coming from said guide means, are fixed for winding and unwinding said guide cables, with said at least one cable drum being provided with spring-wound motor means for keeping said guide cables taut;

a cable drum for each two guide cables, including four guide cables and two cable drums, with the latter being centered between four guide means;

said guide means for said guide cables being spaced from one another in such a way as to define a quadrilateral shape; and a guide plate that is provided on said support structure, with said guide cables being connected to the latter at attachment locations that define a quadrilater shape, with the distance between said attachment locations being considerably less than the distance between said guide means.

6. An apparatus according to claim 5, which includes a locking mechanism to prevent said cable drums from unintentionally winding and unwinding said guide cables.

7. An apparatus according to claim 6, in which said cable drums are provided with tooth means, and said locking mechanism includes locking pin means that is adapted to engage said tooth means.

8. An apparatus according to claim 5, in which each of said guide means for said guide cables includes a fixed cable pulley and a cable pulley that swings.

9. An apparatus according to claim 6, in which said carriage includes a carriage that supports a frame structure on which said cable drums and said locking mechanism are disposed.

10. An apparatus according to claim 9, in which said frame structure is removably secured to said carrier of said carriage.

11. An apparatus according to claim 5, in which said support structure is provided with a ballast, the weight of which is at least equal to the force of said spring-wound motor means of said at least one cable drum.

12. An apparatus for a crane or the like to stabilize a load carried thereby, with said crane including a support structure that can be raised or lowered by a lifting mechanism of a movable carriage, said apparatus comprising:

a guide mechanism that is disposed on said support structure and includes: downwardly diverging hydraulic cylinders with piston rods; a girder that is provided with load-receiving means and is connected to said piston rods of said hydraulic cylinders, remote from said support structure, in such a way as to essentially form the shape of a triangle, with said girder defining the base of said triangle; and a hydraulic line that interconnects said hydraulic cylinders for alternate retraction and extension of said piston rods thereof, said hydraulic line being associated with a hydraulic reservoir and two valves having respective switching stems that are spaced from one another; said guide mechanism including an attachment which is provided, remote from said support structure, with an actuating pendulum that is disposed between said two valve stems.

13. An apparatus according to claim 12, in which said lifting mechanism is provided with a crane hook in which said attachment of said guide mechanism can be suspended; and in which said attachment includes a support body to which said hydraulic cylinders and said pendulum are connected.

14. An apparatus for a crane or the like to stabilize a load carried thereby, with said crane including a support structure that can be raised or lowered by a lifting mechanism of a movable carriage, said apparatus comprising:

a guide mechanism that is disposed on said support structure and includes: downwardly diverging hydraulic cylinders with piston rods; a girder that is provided with load-receiving means and is connected to said piston rods of said hydraulic cylinders, remote from said support structure, in such a way as to essentially form the shape of a triangle, with said girder defining the base of said triangle; and a hydraulic line that interconnects said hydraulic cylinders for alternate retraction and extension of said piston rods thereof;

said hydraulic line being associated with a hydraulic reservoir and two valves having respective switching stems that are spaced from one another; said guide mechanism including an attachment which is provided, remote from said support structure, with an actuating pendulum that is disposed between said two valve stems;

said lifting mechanism being provided with a crane hook in which said attachment of said guide mechanism can be suspended; said attachment including a support body to which said hydraulic cylinders and said pendulum are connected;

a safety plate having at least one notch being disposed on said support body of said attachment; and pawl means displaceably mounted on said support structure, with said pawl means being adapted to engage said at least one notch to prevent twisting and turning of said guide mechanism.

15. An apparatus according to claim 14, in which said safety plate is essentially in the form of a circular disk having a peripheral rim in which said at least one notch is provided.

* * * * *

UNITED STATES PATENT AND TRADEMARK OFFICE

CERTIFICATE OF CORRECTION

PATENT NO. : 4,842,150

DATED : June 27, 1989

INVENTOR(S) : Tomislav Potocnjak

It is certified that error appears in the above-identified patent and that said Letters Patent is hereby corrected as shown below:

On the title-abstract page, the name of the Assignee should be corrected to read as follows:

[73] Assignee: TEPORA Transportsysteme Entwicklungs-GmbH, Lauffen, Fed. Rep. of Germany

Signed and Sealed this

Tenth Day of April, 1990

*Attest:*

HARRY F. MANBECK, JR.

*Attesting Officer*

*Commissioner of Patents and Trademarks*